United States Patent [19]

Walker

[11] 4,103,434

[45] Aug. 1, 1978

[54] DRYING APPARATUS

[76] Inventor: Richard Turner Walker, 175 S. Creek Rd., Dee Why 2099 Sydney, Australia

[21] Appl. No.: 700,568

[22] Filed: Jun. 28, 1976

Related U.S. Application Data

[63] Continuation of Ser. No. 362,490, May 21, 1973, abandoned.

[30] Foreign Application Priority Data

May 30, 1972 [AU] Australia ..... PA9144

[51] Int. Cl.[2] ..... F26B 13/08

[52] U.S. Cl. ..... 34/114; 34/121; 34/156; 34/159; 432/8

[58] Field of Search ..... 34/114, 111, 119, 120, 34/122, 124, 121, 155, 156, 161, 159; 432/8, 59

[56] References Cited

U.S. PATENT DOCUMENTS

| | | | |
|---|---|---|---|
| 2,099,160 | 11/1937 | Church | 34/48 |
| 2,939,222 | 6/1960 | Svavar et al. | 34/18 |
| 3,303,576 | 2/1967 | Sisson | 34/115 |
| 3,925,906 | 12/1975 | Chance et al. | 34/123 |

*Primary Examiner*—John J. Camby
*Assistant Examiner*—Larry I. Schwartz
*Attorney, Agent, or Firm*—Fulwider, Patton, Rieber, Lee & Utecht

[57] ABSTRACT

A drying apparatus suitable for use in the drying of paper web and which comprises a housing, rollers located within the housing for supporting the paper web which is transported through the housing, and means for applying heat to the rollers. The heat is applied directly to the rollers' periphery and at such a level as to cause vaporization of moisture contained within the web, whereby a vapor layer is created between the web and the portion of the rollers' periphery which would otherwise be contacted at any given time by the web.

11 Claims, 1 Drawing Figure

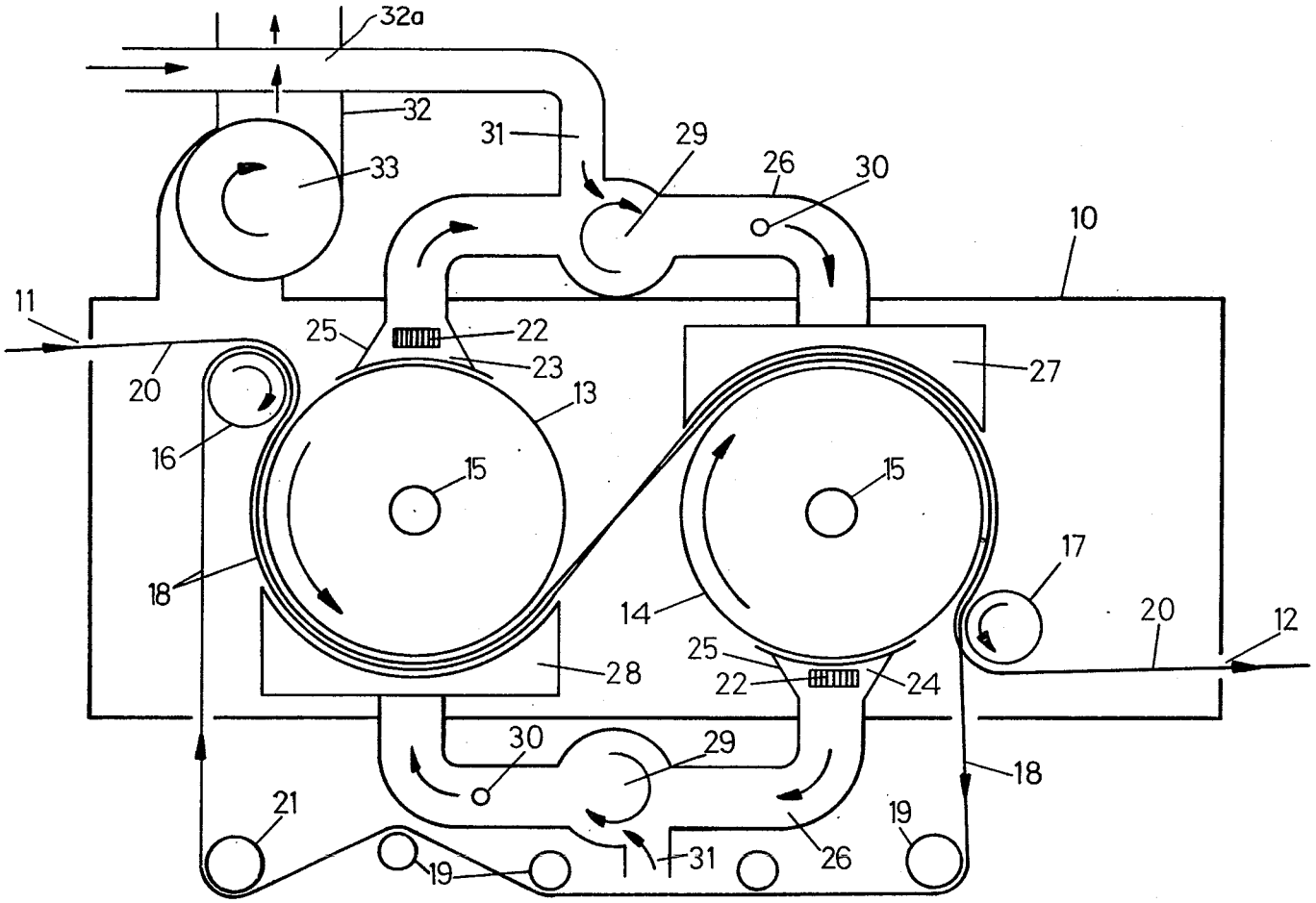
10
11
12
13
14
15
15
16
17
18
18
19
19
20
20
21
22
22
23
24
25
25
26
26
27
28
29
29
30
30
31
31
32
32a
33

DRYING APPARATUS

This is a continuation, of application Ser. No. 362,490, filed May 21, 1973, now abandoned.

This invention relates to an apparatus for employment in drying lengths of a material fed thereto.

The drying apparatus (as below defined) has particular application in the drying of a paper or board web following its passage through a paper or board forming or processing plant but, although the invention is described as follows in this context, it is to be understood that the invention need not be so limited.

Paper drying machines currently employed comprise a number of heated drum type rollers which transport a web of paper through the machine in a serpentine fashion. The rollers are heated with pressurized steam which is delivered to the interior of the rollers from an external generator and the paper is held in close contact with the periphery of the rollers by a system of guided felts.

Such known dryers have certain inherent disadvantages: In their use of steam as a heating (drying) medium, considerable capital expenditure is required in the installation and maintenance of steam generating plant, the rollers must be constructed as heavy duty pressure vessels (and the various Codes controlling construction and inspection of such vessels adhered to), the rollers must be continually doctored (i.e., wiped) in order to preserve efficient heat transfer to the paper web, the paper web must be held in close contact with the rollers (this requiring the provision of felts and a guiding/tensioning system), and the run-up time for the machine is restricted by the time required for steam raising and stabilising of temperatures. Moreover, a high powered transmission system is required for driving the heavy duty rollers and, because the paper web is maintained in contact with the surface of the rollers, the surface of the rollers must be kept clean and smooth.

The present invention seeks to at least in part obviate the above disadvantages of known machines by providing a drying apparatus comprising a housing, at least one roller located within the housing for supporting a length of material transported through the housing, and means for applying heat to the roller(s) sufficient to vaporise moisture contained within the material to be dried and to create a layer of vapour between the material and the portion of the roller periphery which would otherwise be contacted at any given time by the material.

It will be appreciated that, by adoption of the apparatus above defined and by creation of a vapour layer or barrier between the roller(s) and the material, the need for smooth-surfaced rollers is obviated, as is the need for doctoring of the rollers and a high power drive transmission system.

There are preferably at least two said rollers and the rollers are preferably heated by gas combustion, the flame of combustion being directed against either an internal or an external peripheral portion of the rollers. This then avoids the need for condensate removal from the interior of the rollers and for the provision of pressure vessel type rollers and steam generating plant. Consequently, the rollers may be of a much lighter construction than those conventionally employed, this reducing still further the need for a high capacity drive system. Also, the run-up time for the apparatus is reduced and, by the material being supported upon a layer or cushion of vapour, the material is not degraded by overheating of the rollers.

Hot air generated as a result of gas combustion adjacent the periphery of one roller (i.e., each one of the rollers) is preferably transferred from the respective combustion zones and directed onto a portion of the material which is at any one time passing around the periphery of another roller. Thus, with this preferred construction, the material is dried from both surfaces thereof (i.e., by heat transfer from the roller surface and by hot gas impingement) and drying conditions may be accurately controlled by temperature control of the roller surface and/or the hot gases of combustion. With this preferred construction, the major contribution toward drying of the material may be made by the hot gas impingement.

Moreover, the heating temperature gradient between successive rollers may be chosen or regulated to induce a desired gas flow within the housing. Thus, moisture laden gas may be caused to flow to a specifically selected zone within the housing, from which it may be extracted. Residual heat contained within the extracted gas may then be used to preheat dry air which is directed into the housing.

The invention will be more fully understood from the following description of a preferred embodiment thereof, taken in conjunction with the accompanying drawings:

The drawing is a schematic representation of a paper web drying apparatus and although it shows two only paper transfer rollers it must be appreciated that such apparatus would normally comprise a considerably greater number of rollers.

As illustrated, the drying apparatus comprises a housing 10 having insulated walls and counterbalanced doors (not shown) at the inlet and exit ends 11 and 12 thereof.

Drying rollers 13 and 14 are located within the housing and they are journalled for rotation on or with axles 15. The rollers are constituted by relatively lightweight steel drums.

A paper feed lead roll 16 is located within the housing adjacent the inlet end thereof, and a spring loaded tension roll 17 is located adjacent the exit end of the housing. The tension roll 17 functions to maintain a constant (pre-selected) tension in a paper web 20 as it passes over the drying rollers 13 and 14.

A pair of endless, laterally spaced steel driving wires 18 pass around the lead roll 16 and, in serpentine fashion, around the drying rollers 13 and 14. The driving wires return to the lead roll 16 by passing by the tension roll 17 and around wire tension rolls 19.

Drive is transmitted to the drying rollers 13 and 14 by way of the driving wires 18 and from a single motor drive unit 21.

The driving wires 18 are also employed for feeding the paper web 20 through the apparatus at the commencement of paper feed. Thus, although the wires would be spaced-apart by a distance greater than the normal width of the paper web 20, such that they do not normally make contact with the paper web, the (initial) feed end of the web would be offset so as to lie under one of the wires 18 and thereby be carried trough to the tension roll 17.

Burners 22 are located in combustion zones 23 and 24 adjacent the periphery of the respective drying rollers 13 and 14, the combustion zones being located at the side of the rollers opposite that about which the driving wires 18 and the web 20 wrap. The burners 22 are fed with a combustible gas (for example, coal gas or a liquid petroleum gas) and combustion supporting air by way of separate conduits (not shown), and the burners are orientated to direct a combustion flame against or toward the periphery of the rollers 13 and 14.

The burners 22 are housed within a shroud 25 which communicates with air transfer ducts 26 at the respective sides of the drying rollers.

Hot air produced as a result of gas combustion adjacent the periphery of rollers 13 and 14 is transferred through the respective ducts 26 and into hoods 27 and 28. Transfer of the hot air is induced by a blower 29 in each duct and the temperature of the air is detected by sensors 30. Temperature control of the drying system is effected by regulating gas flow to the burners 22 and by admission of external air via conduits 31. Air admitted to the system by way of the conduits 31 may be preheated as hereinafter described.

A lateral air flow control device (not shown) is located within each of the hoods 27 and 28 for distributing the hot air flow across the full width of the paper web 20.

In the apparatus described so far, gas combustion at the burners 22 results in direct heating of the periphery of rollers 13 and 14 (typically, to a temperature of approximately 115° C) and, consequently, a layer or cushion of steam is created between the rollers and the wet paper web 20 passing around the rollers. At the same time, air heated as a result of the gas combustion at, say, the burner 22 adjacent roller 13 is directed onto the paper web passing around roller 14. The paper is therefore dried from both surfaces thereof, with the greatest drying effect resulting from impingement of the hot air from the hoods 27 and 28, and the paper web is prevented from contacting the rollers 13 and 14 because of the prevailing steam layer.

In transferring the hot air of combustion from the area of the burners 22 and through the respective ducts 26 to the hoods 27 and 28, care must be taken to restrict or prevent scavenging of steam from about the rollers 13 and 14. If an insufficient volume of air is available (without scavenging steam) to effect efficient drying in the area of the hoods 27 and 28, an appropriate make-up volume of air must be delivered into the ducts 26 by way of the conduits 31.

The heating temperature gradient between the successive rollers 13 and 14 or, more particularly, between the hot air flow from the successive hoods 28 and 27 is adjusted to provide a resultant free air current flow from the exit to the inlet ends of the housing 10. Then, with this arrangement, moisture laden air within the housing is moved toward the inlet end 11 of the housing and is extracted, through a duct 32, by a blower 33. The hot, humid waste gases expelled through the duct 32 may be passed through a heat exchange system 32*a* and be utilised to preheat air entering the system via conduits 31 and/or to provide useful heat at other stations in a paper or board making process.

In an alternative arrangement of the invention, the moisture laden air might be removed from the housing at a number of spaced points and, preferably, from points adjacent each of the rollers.

I claim:

1. A drying apparatus comprising:

a housing;

a plurality of spaced-apart, imperforate roller means located within the housing with spaced-apart circumferences for supporting a fibrous web of material transported through the housing;

means to introduce fibrous web material to be dried into said housing located adjacent to, but spaced apart from, the first of said roller means;

guide means to direct said fibrous web material to overlie at least a portion of each of said roller means;

means to drive each of said roller means;

heating means to heat the roller means sufficient to expand by vaporization, moisture contained within the fibrous material to be dried; and web material tensioning means located adjacent to and spaced-apart from the last of said roller means to apply sufficient tension to said web material to permit said web material to be transported through said housing about said roller means and spaced-apart from the periphery thereof by a layer of vapor from said vaporized moisture which discharges from the side of the web adjacent the portion of the roller periphery which would otherwise be contacted at any given time by the material but for the presence of said vapor layer.

2. A drying apparatus as claimed in claim 1, wherein the roller means are engaged about a portion of their periphery by a pair of endless driving wires spaced apart by a distance greater than the width of said material, the wires being passed through the housing and around the rollers in a serpentine fashion, and drive means connected to said wires to impart rotational motion to the rollers.

3. A drying apparatus as claimed in claim 1, wherein said heating means is a plurality of burners, each positioned to direct its flame of combustion against a peripheral portion of a respective roller means and heat said roller means at a level to cause vaporization of moisture of said web and create said vapor layer.

4. A drying apparatus as claimed in claim 3, wherein duct means are provided to transfer and direct hot air which is generated as a result of gas combustion adjacent the periphery of one roller means from the zone of combustion onto a portion of the material which is at any one time passing around a peripheral portion of another roller means.

5. A drying apparatus as claimed in claim 4, wherein said duct means comprises a shroud about the burner adjacent one said roller, a hood which is disposed adjacent the periphery of another said roller, and a hot air transfer duct in communication therebetween with an air transfer impeller in said transfer duct.

6. A drying apparatus as claimed in claim 5, wherein a conduit is connected with the transfer duct for delivery into the duct of a supplementary volume of air from an external source.

7. A drying apparatus as claimed in claim 6, including means associated with the conduit for preheating the supplementary volume of air.

8. A drying apparatus as claimed in claim 7, wherein one said hood is disposed adjacent the peripheral portion of each roller about which the material passes.

9. The drying apparatus of claim 1, wherein said heating means is positioned externally of each of said roller means and is directed to heat the uncovered peripheries of said roller means to effect direct heating thereof.

10. The drying apparatus of claim 9, wherein said roller means are of light, unpressured construction and said heating means consist of a plurality of burner means.

11. The drying apparatus of claim 10, wherein said heating means is a plurality of gas burners one each positioned to direct its flame against the uncovered periphery of a respective roller means.

* * * * *